United States Patent [19]

Gordon et al.

[11] Patent Number: 4,754,917

[45] Date of Patent: Jul. 5, 1988

[54] END CLOSURE CONSTRUCTION FOR LIQUID CONTAINERS

[75] Inventors: Robert L. Gordon, Monroe; Roderick W. Kalberer, Salisbury Mills, both of N.Y.

[73] Assignee: International Paper Company, Purchase, N.Y.

[21] Appl. No.: 890,228

[22] Filed: Jul. 29, 1986

[51] Int. Cl.[4] ..... B65D 5/08

[52] U.S. Cl. ..... 229/137; 229/3.1; 229/48 T

[58] Field of Search ..... 229/3.1, 17 R, 176, 229/48 SA, 48 SC, 48 T, 137, 138, 132

[56] References Cited

U.S. PATENT DOCUMENTS

| | | | |
|---|---|---|---|
| 2,959,336 | 11/1960 | Mosse et al. | 229/17 G |
| 3,302,846 | 2/1967 | Wilcox | 229/17 G |
| 3,549,080 | 12/1970 | Gill | 229/17 R |
| 4,192,446 | 3/1980 | Naito | 229/17 R |
| 4,442,970 | 4/1984 | Farber | 229/17 G |

FOREIGN PATENT DOCUMENTS

| | | | |
|---|---|---|---|
| 181669 | 12/1935 | Switzerland | 229/17 R |

*Primary Examiner*—Stephen Marcus
*Assistant Examiner*—Gary E. Elkins
*Attorney, Agent, or Firm*—Walter Thomas Zielinski

[57] ABSTRACT

An end closure construction for a tube-type container formed from a single paperboard blank, the blank having an extruded barrier layer coating on one surface thereof. The carton has at least one end closure which is flat and defined by end closure panels. To prevent excessive overlapping of paperboard layers at the center of the flat, closed carton end, each one of a pair of facing end closure panels is centrally recessed along its free edge. An abutment tongue on one of the facing end closure panels is bordered by a pair of recesses. Each of the recesses is spanned by the extruded barrier layer coating. The abutment tongue bears against the oppositely positioned barrier layer to form gussets, in a controlled manner, from the barrier layer.

13 Claims, 2 Drawing Sheets

END CLOSURE CONSTRUCTION FOR LIQUID CONTAINERS

BACKGROUND OF THE INVENTION

This invention relates to an end closure construction for a tube-type carton, such as a paperboard carton for containing milk, juices, or other liquids.

Typically, a roll of paperboard is often extrusion coated with barrier laminations of polymers and foils for the purpose of rendering the eventual paperboard container liquid tight and provide the required product protection, with the blank thereafter being folded and heat sealed to define an erected or completed container. Such cartons are fashioned from a single blank of paperboard, suitably scored so as to provide desired fold or hinged lines.

A variety of end closure constructions for such tube-type containers is known. For example, one well known construction is the so-called gable top construction commonly employed for milk cartons. The bottom of such a carton is closed in such a manner that it is flat, while the upper portion is provided with a top in the form of a gable (house) roof, with the top being opened by the consumer to define a pour spout, the spout usually being reclosable.

Another type of end closure for the top of such a carton is a flat-topped end closure which is the same container without the gable, the end closure instead being fin sealed with the fin being folded over. Such closures for the top of a liquid carrying container exhibited the advantage of being easier to store because the carton has a flat top. Often, such flat-topped containers suffer the drawback of overlapping of several paperboard layers at the center of the closure. Such multiple thicknesses of paperboard are sometimes difficult to seal properly by use of heat and pressure and further exhibit the drawback of exposed paperboard edges and stress cracking of the barrier materials. These edges and cracks allow for migration of bacteria, oxygen, and wetting of the product into any exposed fibers of the paperboard which may be present. Thus, the product freshness and shelf life are shortened.

SUMMARY OF THE INVENTION

According to the practice of this invention, an improved flat-topped end closure construction is made possible by firstly providing one of the four end closure panels with a rectangular recess or cutout, the recess bordering centrally on the free edge of that end closure panel. The opposite end closure panel is provided with a recess, also centrally located along its free or exposed edge. Each of the recesses is spanned or covered by the barrier layer extrusion material which is applied to that surface of the blank which is to become the inner surface of the completed or erected container. In closing the container, according to this invention, those opposite end closure panels which are provided with recesses along their free edges are bent or folded towards each other, with one of the panels carrying an abutment tongue defined by cutouts. The abutment tongue, as the panels are hinged towards each other, engages the deformable (extrusion) membrane of the first mentioned end closure panel (the membrane defined by the barrier layer extrusion material) and deforms this membrane in a controlled manner, to define folded gussets, as opposed to random folding. In the completed or closed condition, the abutment tongue overlies the now deformed and gusseted membrane to effect a liquid barrier seal which exhibits substantial sealing properties and which also does away with much of the prior art overlapping of paperboard layers at the center of the end closure. The remaining two end closure panels, in the completed flat-topped configuration of the end closure, have their free edges in substantially abutting relationship.

This rectangular parallelepiped construction allows for the placement or attachment of a pouring device on the flat top end of the container. Due to the folding sequence and end construction, a single layer of paperboard is at each end of the rectangular top, which in turn allows for easier attachment of the pouring device than with multiple paperboard layer constructions.

Another feature of this invention resides in the replacement of a standard square milk container with a rectangular parallelepiped design for ease of handling, storage and consumer convenience. Another feature of the invention resides in the provision of a clean flat end surface for a container to thereby yield improved graphics and placement of pouring devices.

A flat top surface is provided with fewer multiple overlaps of paperboard at its center than somewhat similar flat top closures of the prior art. These multiple overlaps cause problems in sealing and sterilizing the containers for aseptic use. Microbes tend to migrate or reside under the overlaps, and the usual antimicrobial peroxide treatment is not completely effective.

DETAILED DESCRIPTION OF THE INVENTION

Figure 1:
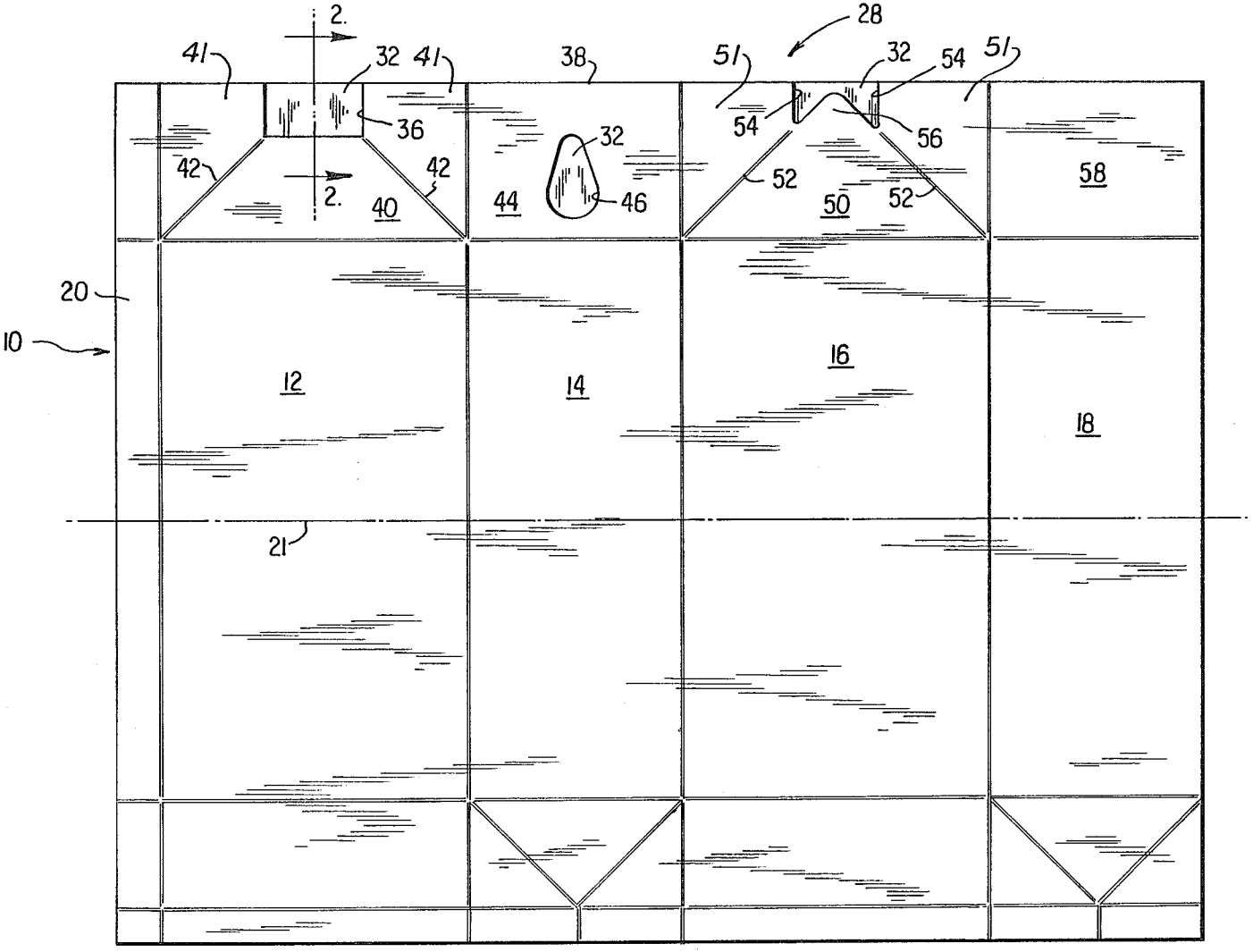
FIG. 1 is a plan view of the one-piece paperboard carton blank of the invention.

Referring now to FIG. 1 of the drawings, the number 10 denotes generally a paperboard blank having side forming panels 12, 14, 16 and 18 foldably connected to each other along indicated fold lines. A manufacturer's flap 20 is integrally and foldably attached to free end of panel 18. The numeral 21 denotes an imaginary longitudinal axis of the blank. The numeral 26 denotes the bottom closure configuration of the blank, formed by suitably scoring the bottom of the blank to form the indicated fold lines, with the fold lines being adapted to permit the formation of bottom closure panels for the container. The configuration of the fold lines at 26 is conventional and forms no part of this invention.

Figure 2:
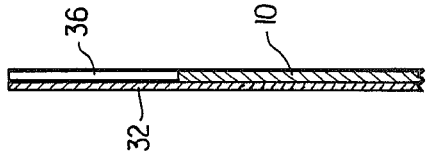
FIG. 2 is a cross section taken along section 2—2 of FIG. 1.

The numeral 28 denotes the upper portion of the blank and includes a plurality of end closure panels defined by the indicated score lines, the score lines defining fold or hinge axes or lines. The numeral 32, also shown at FIG. 2, denotes a barrier layer extrusion coating on that surface of the blank 10 which will be the interior of the carton formed from the blank. The thickness of layer 32 is exaggerated for purpose of illustration.

The numeral 36 denotes a recess or cutout, generally rectangular in shape and bordering on the upper free edge 38 of the blank, this edge also defining the upper or free edges of the individual top end closure panels, shortly to be described. Layer 32 spans and completely covers recess 36.

The numeral 40 denotes a first end closure panel having a pair of slanted fold lines 42, the latter intersecting recess 36. The numeral 44 denotes an adjacent end closure panel, this panel being provided with a recess 46 which is also spanned or covered by the barrier layer material coating 32. The opening 46 is for a dispensing purpose and will not be further described, since it forms no part of this invention. Additional openings and dispensing devices are described in more detail in co-pending applications.

The numeral 50 denotes another top end closure panel, also provided with a pair of slanted fold lines 52. The numeral 54 denotes either one of two generally triangular recesses which are spanned or covered by barrier layer 32. The number 56 denotes the uppermost, triangular mid-portion of panel 50, numeral 56 denoting, for reasons which will become apparent later, an abutment tongue. The numeral 58 denotes another top end closure panel. It will be observed that each of the top end closure panels is hingeably connected to the others, except for the free endmost portions of panels 40 and 58.

Figure 3:
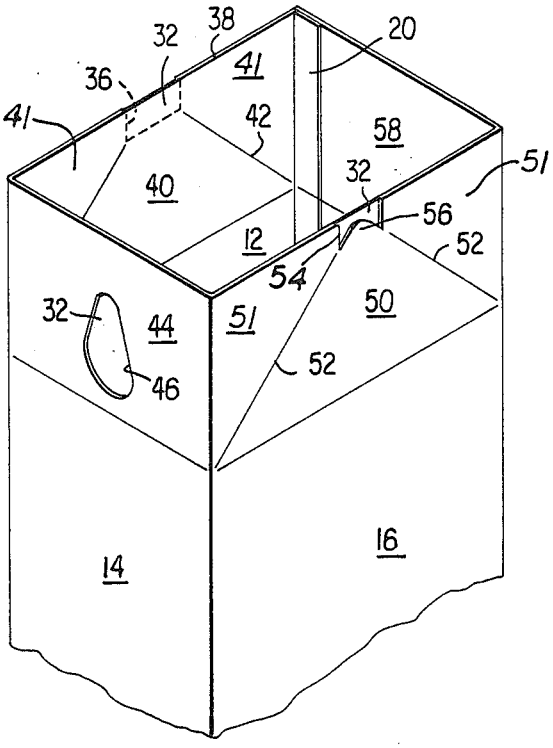
FIG. 3 is a perspective view of the blank after it has been folded to form a tube-type container, the container having an end which is still open.

Referring now to FIG. 3 of the drawings, the blank 10 has been folded to form a tube-type container which is rectangular in transverse cross section, i.e., a cross section transverse to the longitudinal axis of the tube.

Figure 4:
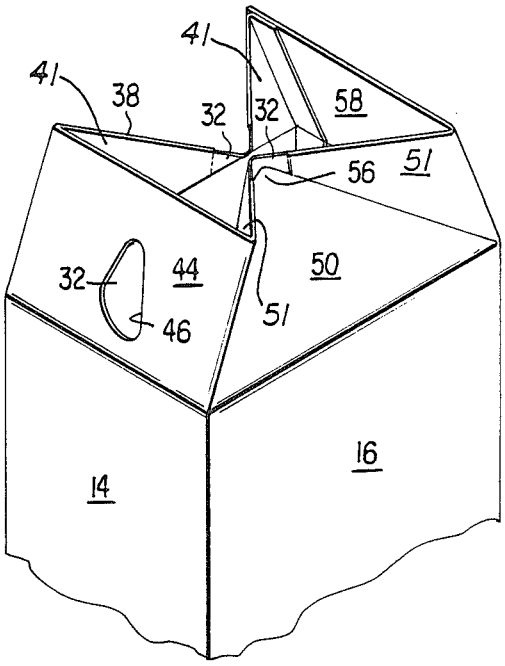
FIGS. 4–6 show the container end of FIG. 3 at successive stages of the end closure.
Figure 5:
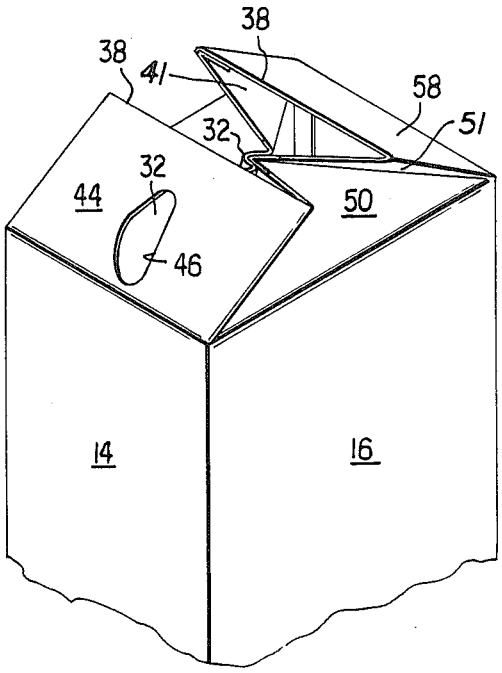
Figure 6:
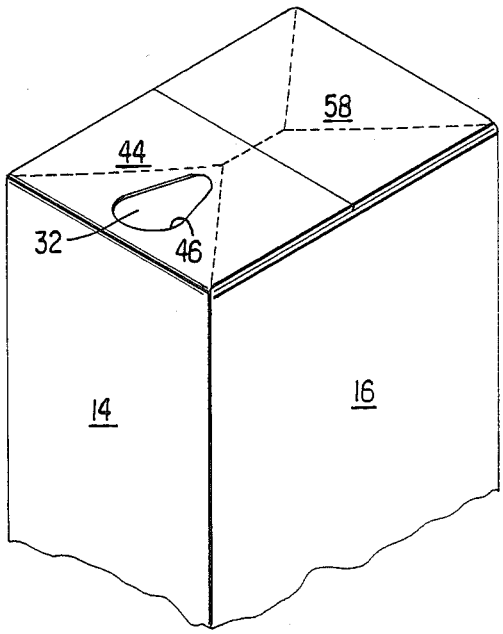

FIGS. 4, 5 and 6 illustrate successive stages in the folding of the end closure panels to form the completed flat-topped end closure.

During end closure, it will be observed that alternate, opposite end panels 40 and 50 are folded towards each other, with tongue abutment 56 engaging the central portion of the unsupported web or membrane barrier layer 32 in panel 40 which spans opening 36. It will further be observed, during later stages in the closing, that the vertically disposed, short edges of opening 36 (as viewed at FIG. 3) contact web portions 32 of panel 50. This action, in conjunction with abutment tongue 56 pushing and deforming membrane or web 32 of opening 36, causes the formation of folded gussets in web 32. The abutment tongue thus defines a means for forming gussets. In the final, closed configuration shown at FIG. 6, the right-hand panel portions 41, 51 lie in a plane, this plane being coplaner with another plane defined by the left-hand panel portions 41, 51. Further free edges 38 of panels 58 abuts free edge 38 of panel 44. The top surface of the carton is thus flat and thus amenable for graphics.

In those uses of the carton for packaging and storing liquids over relatively long periods of time, the exposed free edge of manufacturer's panel 20 may be skived and the adjacent barrier layer laminate membrane 32 deformed over the skived portion, to prevent wicking of this free edge. This construction is known in this art and forms no part of the present invention.

FIG. 6 illustrates, by means of the dashed lines on the carton upper end, the single thickness of paperboard in which the dispensing opening 46, or another pour device, is located.

In forming the blank shown at FIG. 1, the paperboard web material, as from a large roll, is cut and scored to form the indicated fold lines and the cutouts 36 and 54. At least one surface is extrusion coated (layer 32), such coating typically defined by a five or more layer laminate. One example of such an extrusion coated laminate is defined by polyethylene-paperboard-polyethylene-metal foil such as aluminum, and polyethylene.

While illustrated as closing the top of the carton, the end closure of this invention may also be employed to close the bottom.

Pour spout fitments which can be employed with opening 4 are shown and described in copending U.S. patent application Ser. Nos. 890,229 and 890,252, each entitled Pour Spout For Containers, by the same inventors and filed on even date herewith.

What is claimed is:

1. A carton blank of stiff, resilient and foldable sheet material, such as paperboard, the blank adapted to be folded to form a tube and adapted to contain a foodstuff such as milk or a juice, the blank including four parallel and generally rectangular side forming panels foldably connected together and having at one end of each a respective end closure panel hinged thereto, each end closure panel being generally rectangular, the end closure panels being foldably joined to each other, each end closure panel having a free edge, first and second alternate ones of said end closure panels each having a pair of fold lines, each fold line of each pair extending from a corner of the respective alternate end closure panel towards a mid-portion of the free edge thereof, the first alternate end closure panel having a recess at the mid-portion of its free edge, a deformable sheet membrane attached to the blank and spanning said first alternate end closure panel recess, the pair of fold lines in said first alternate end closure panel intersecting said recess, the second alternate closure panel having a pair of recesses each of which is located on a respective side of the mid-portion of the free edge of the second alternate closure panel, said pair of recesses defining a triangular abutment tongue, the abutment tongue defining a means for forming gussets in the deformable membrane in the said first alternate end panel, a deformable sheet attached to the blank and spanning said pair of recesses, the free end of the abutment tongue extending towards the free edge of said second alternate closure panel.

2. The carton blank of claim 1 wherein the free edge of the abutment tongue is rounded.

3. The carton blank of claim 1 wherein the free end of the abutment tongue extends substantially to, but short of, an imaginary axis along the free edge of the second alternate closure panel.

4. The carton blank of claim 1 wherein the blank is coated on one surface thereof with a liner defined by a barrier extrusion, said barrier extrusion defining the deformable sheets.

5. The carton blank of claim 2 wherein the blank is coated on one surface thereof with a liner defined by a barrier extrusion, said barrier extrusion defining the deformable sheets.

6. The carton blank of claim 3 wherein the blank is coated on one surface thereof with a liner defined by a barrier extrusion, said barrier extrusion defining the deformable sheets.

7. The carton blank of claim 4 wherein said recess in the first alternate closure panel is generally rectangular with one side thereof being extendable along an imaginary axis along the free edge of the first alternate closure panel.

8. The carton blank of claim 1 wherein said recesses in the second alternate end closure panel are in the form of isosceles triangles, one equal leg of each extending along an imaginary axis along the free edge of the second alternate end panel.

9. The carton blank of claim 1 wherein said first and second alternate end closure panels are of equal length, measured along their free edges, and are longer than the remaining end closure panels, as measured along the free edges of the latter.

10. An end construction for a tube-type carton formed of a one-piece blank of stiff, resilient and foldable material, such as paperboard, the carton being of rectangular shape in transverse cross-section, a plurality of rectangular end panels to define a flattened end closure, each end closure panel being generally rectangular and foldably attached to a respective side panel and to each other and each having an endmost free edge, a first of the end closure panels having a recess bordering on its free edge and located centrally therealong, said recess being spanned and covered by a deformable web, a second end closure panel opposite to the first and having an abutment tongue near its free edge and centrally thereof, said first and second end closure panels each having a pair of fold lines, each fold line of each pair extending from a corner of the respective first and second end closure panel towards a mid-portion of the endmost free edge thereof, the first and second end closure panels having their central portions folded towards each other, said abutment tongue abutting and deforming said web into gussets, said abutment tongue at least partially overlying said first end closure panel, the remaining two, and oppositely facing, end closure panels being folded towards each other with each overlying a portion of the first and second end closure panels with their free ends in substantial abutment with each other.

11. The end construction of claim 10 wherein said deformable web is a barrier layer laminate extruded onto the carton interior surface.

12. The end construction of claim 10 wherein said abutment tongue is bordered on both of its sides by openings bordering on the free edge of the end closure panel which carries the abutment tongue, said abutment tongue bordering openings being spanned and covered by said deformable web.

13. The end construction of claim 12, wherein said deformable web is a barrier layer laminate extruded onto an interior surface of said carton.

* * * * *